US010872592B2

(12) United States Patent
Hull et al.

(10) Patent No.: US 10,872,592 B2
(45) Date of Patent: Dec. 22, 2020

(54) NOISE-CANCELING HEADPHONES INCLUDING MULTIPLE VIBRATION MEMBERS AND RELATED METHODS

(71) Applicant: Skullcandy, Inc., Park City, UT (US)

(72) Inventors: Randall J. Hull, Park City, UT (US); Branden Sheffield, Saratoga Springs, UT (US); John Timothy, Salt Lake City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 15/843,821

(22) Filed: Dec. 15, 2017

(65) Prior Publication Data

US 2019/0189106 A1 Jun. 20, 2019

(51) Int. Cl.
*G10K 11/178* (2006.01)
*H04R 1/10* (2006.01)
(Continued)

(52) U.S. Cl.
CPC .. *G10K 11/17823* (2018.01); *G10K 11/17853* (2018.01); *H04R 1/105* (2013.01);
(Continued)

(58) Field of Classification Search
CPC ..... G10K 11/17823; G10K 11/17853; G10K 2210/1081; G10K 2210/3026;
(Continued)

(56) References Cited

U.S. PATENT DOCUMENTS 5,280,543 A 1/1994 Yokoyama et al.
6,078,672 A 6/2000 Saunders et al.
(Continued)

FOREIGN PATENT DOCUMENTS

CN 101184345 A 5/2008
CN 104811838 A 7/2015
(Continued)

OTHER PUBLICATIONS

U.S. Appl. No. 15/898,383, filed Feb. 16, 2018, titled "Headphone With Noise Cancellation of Acoustic Noise From Tactile Vibration Driver", to Sheffield, 26 pages.
(Continued)

*Primary Examiner* — Vivian C Chin
*Assistant Examiner* — Douglas J Suthers
(74) *Attorney, Agent, or Firm* — TraskBritt

(57) ABSTRACT

Noise-canceling headphones may include a headband, an audio input, and earcups supported proximate ends of the headband. A first vibration member operatively connected to the audio input, a second vibration member operatively connected to the audio input, and a microphone may be supported by a housing of at least one of the earcups. A feedback, noise-cancelation circuit configured to reduce a user's perception of an undesirable audible response of the second vibration member may be operatively connected to the microphone. The feedback, noise-cancelation circuit may be configured to modify an audio signal from the audio input at least in part based on a signal from the microphone and send the modified audio signal to the first vibration member. The modified audio signal may be configured to at least partially cancel at least a portion of an audible response of the second vibration member.

20 Claims, 9 Drawing Sheets

(51) Int. Cl.

| | |
|---|---|
| ***H04R 19/04*** | (2006.01) |
| *H04R 3/02* | (2006.01) |
| *H04R 1/26* | (2006.01) |
| *H04R 5/033* | (2006.01) |

(52) U.S. Cl.
CPC ..... *H04R 1/1008* (2013.01); *H04R 1/1058* (2013.01); *H04R 1/1083* (2013.01); *H04R 19/04* (2013.01); *G10K 2210/1081* (2013.01); *G10K 2210/3026* (2013.01); *G10K 2210/3027* (2013.01); *G10K 2210/3028* (2013.01); *G10K 2210/3056* (2013.01); *H04R 1/26* (2013.01); *H04R 3/02* (2013.01); *H04R 5/033* (2013.01); *H04R 2201/003* (2013.01); *H04R 2205/022* (2013.01); *H04R 2410/05* (2013.01); *H04R 2460/01* (2013.01); *H04R 2460/13* (2013.01)

(58) Field of Classification Search
CPC ... G10K 2210/3027; G10K 2210/3028; G10K 2210/3056; H04R 1/1008; H04R 1/105; H04R 1/1058; H04R 19/04; H04R 2201/003; H04R 1/1083; H04R 2460/13; H04R 2460/01; H04R 3/02; H04R 2205/022; H04R 2410/05; H04R 1/26; H04R 5/033
USPC ..... 381/71.6
See application file for complete search history.

(56) References Cited

U.S. PATENT DOCUMENTS

| | | | |
|---|---|---|---|
| 6,118,878 | A | 9/2000 | Jones |
| 6,377,145 | B1 | 4/2002 | Kumagai |
| 7,103,188 | B1 | 9/2006 | Jones |
| 7,110,551 | B1 | 9/2006 | Saunders et al. |
| 7,177,433 | B2 | 2/2007 | Sibbald |
| 7,489,785 | B2 | 2/2009 | Donaldson et al. |
| 8,045,724 | B2 | 10/2011 | Sibbald |
| 8,054,992 | B2 | 11/2011 | Sapiejewski |
| 8,116,472 | B2 | 2/2012 | Mizuno |
| 8,254,592 | B2 | 8/2012 | Sander et al. |
| 8,401,205 | B2 | 3/2013 | Itabashi et al. |
| 8,416,959 | B2 | 4/2013 | Lott et al. |
| 8,553,900 | B2 | 10/2013 | Cheah et al. |
| 8,965,028 | B2 | 2/2015 | Oishi et al. |
| 9,648,412 | B2 | 5/2017 | Timothy et al. |
| 2008/0112581 | A1 | 5/2008 | Kim et al. |
| 2008/0240484 | A1 | 10/2008 | Tanghe et al. |
| 2010/0005953 | A1 | 1/2010 | Kemmochi et al. |
| 2015/0170633 | A1 | 6/2015 | Nakagawa et al. |
| 2015/0189441 | A1* | 7/2015 | Oishi ..... H04R 5/033 381/309 |
| 2016/0118035 | A1 | 4/2016 | Hyde et al. |
| 2016/0133244 | A1 | 5/2016 | Tzirkel-Hancock et al. |
| 2016/0192060 | A1 | 6/2016 | Noertker et al. |
| 2016/0267898 | A1 | 9/2016 | Terlizzi |
| 2017/0148428 | A1* | 5/2017 | Thuy ..... G10L 25/78 |
| 2017/0208380 | A1 | 7/2017 | Slater et al. |
| 2019/0174217 | A1 | 6/2019 | Sheffield et al. |
| 2019/0189106 | A1 | 6/2019 | Hull et al. |

FOREIGN PATENT DOCUMENTS

| | | | |
|---|---|---|---|
| CN | 105592384 | A | 5/2016 |
| CN | 106792305 | A | 5/2017 |
| EP | 1841278 | A1 | 10/2007 |

OTHER PUBLICATIONS

U.S. Appl. No. 15/832,527, filed Dec. 5, 2017, titled "Headphone With Adaptive Controls", to Sheffield et al., 19 pages.
Löllmann et al., "Generalized Filter-Bank Equalizer for Noise Reduction with Reduced Signal Delay", Sep. 8, 2005, Proceedings of European Conference on Speech Communication and Technology (Interspeech), Lisbon, Portugal, pp. 2105-2108, XP055091633.
European Extended Search Report and Opinion for European Application No. 19157211.4, dated Apr. 5, 2019, 9 pages.
Chinese Office Action for Chinese Application No. 201811443549.2, dated Dec. 3, 2019, 15 pages with translation.

* cited by examiner

NOISE-CANCELING HEADPHONES INCLUDING MULTIPLE VIBRATION MEMBERS AND RELATED METHODS

FIELD

This disclosure relates generally to noise-canceling headphones including multiple vibration members, which may include, for example, multiple audio drivers or at least one audio driver and at least one tactile vibrator, and related methods. More specifically, disclosed embodiments relate to noise-canceling headphones including multiple vibration members that may measure an output of one of the vibration members and utilize another of the vibration members to cancel at least a portion of an audible output of the one of the vibration members to produce an improved sound response.

BACKGROUND

Headphones including active noise cancelation are primarily employed to reduce the impact of environmental noise on the listening experience. For example, feed-forward, noise-cancelation systems typically monitor environmental noise at an exterior of a headphone and use the monitored noise to produce a modified audio signal configured to reduce the impact of the environmental noise on the intended listening experience when sent to an audio driver and used to produce audible sound. As another example, feedback, noise cancelation systems typically monitor noise at an interior of an earcup and use the monitored noise to produce a modified audio signal configured to reduce the impact of environmental noise that has leaked to in the interior of the earcup on the intended listening experience when sent to an audio driver and used to produce audible sound.

BRIEF SUMMARY

In some embodiments, noise-canceling headphones may include a headband, an audio input, and earcups supported proximate ends of the headband. At least one of the earcups may be operatively connected to the audio input and may include a housing, a first vibration member operatively connected to the audio input and supported at least partially within the housing, a second vibration member operatively connected to the audio input and supported at least partially within the housing, and a microphone supported by the housing. A feedback, noise-cancelation circuit may be configured to reduce a user's perception of an undesirable audible response of the second vibration member and may be operatively connected to the microphone. The feedback, noise-cancelation circuit configured to modify an audio signal from the audio input at least in part based on a signal from the microphone and send the modified audio signal to the first vibration member, the modified audio signal configured to at least partially cancel at least a portion of an audible response of the second vibration member.

In other embodiments, methods of making noise-canceling headphones may involve placing a first vibration member operatively connected to an audio input at least partially within a housing of an earcup, placing a second vibration member operatively connected to the audio input at least partially within the housing, and supporting a microphone from the housing. A feedback, noise-cancelation circuit configured to reduce a user's perception of audible noise generated by the tactile vibrator and operatively connected to the microphone may be supported within the housing. The feedback, noise-cancelation circuit may be configured to modify an audio signal from the audio input at least in part based on a signal from the microphone and send the modified audio signal to the first vibration member, the modified audio signal configured to at least partially cancel at least a portion of an audible response of the second vibration member. The earcup may be supported proximate an end of a headband.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular noise-canceling headphone or component thereof, but are merely idealized representations employed to describe illustrative embodiments. Thus, the drawings are not necessarily to scale.

Disclosed embodiments relate generally to noise-canceling headphones including multiple vibration members, an output of one of the vibration members may be detected by one or more microphones and another of the vibration members may be utilized to cancel at least a portion of an audible output of the one of the vibration members to produce an improved sound response. More specifically, disclosed are embodiments of noise-canceling headphone including tactile vibrators that may employ a feed-forward, noise-cancelation system primarily to reduce the impact of environmental noise on the listening experience and a feedback, noise-cancelation system primarily to reduce the impact of noise incidentally produced by the tactile vibrators on the listening experience.

Figure 1:
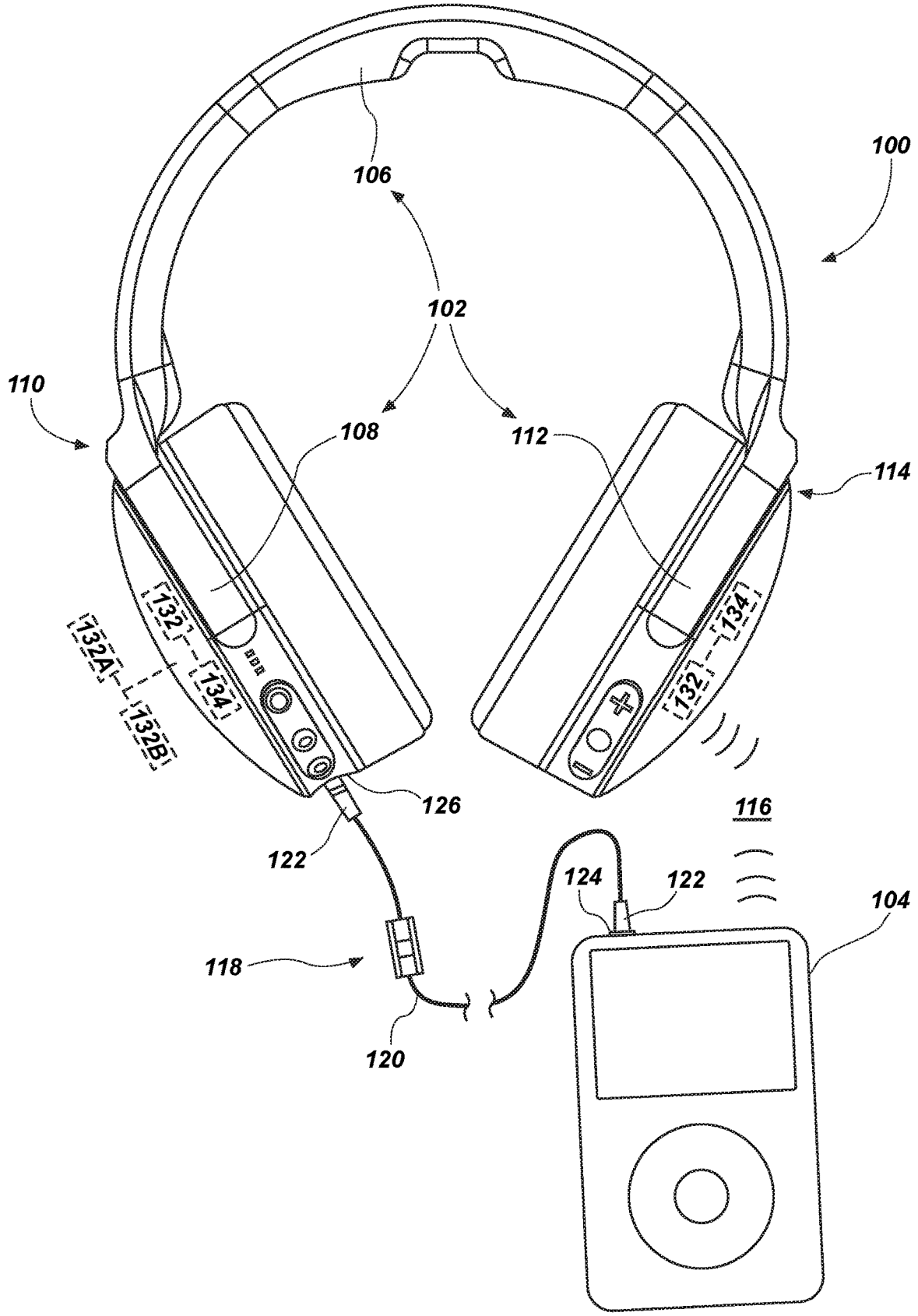
FIG. 1 is a view of an audio system including a side view of a noise-canceling headphone.

FIG. 1 is a view of an audio system 100 including aside view of a noise-canceling headphone 102 configured to receive an audio signal from a media player 104. The noise-canceling headphone 102 may include a headband 106, a first earcup 108 suspended from the headband 106 proximate a first end 110 of the headband 106, and a second earcup 112 suspended from the headband 106 proximate a second end 114 of the headband 106. The headband 106 may be sized and shaped to rest on top of a user's head and the first earcup 108 and second earcup 112 may be positioned to be placed over the user's ears when the noise-canceling headphone 102 is worn by the user.

Each of the first earcup 108 and the second earcup 112 may include a first vibration member 206 (see FIG. 5), which may be specifically configured as an audio driver 132 configured to produce audio playback in response to receipt of an audio signal from the media player 104. Each of the first earcup 108 and the second earcup 112 may further include a second vibration member 196 (see FIG. 5), which may be specifically configured as a tactile vibrator 134 configured to produce tactile vibrations in response to receipt of at least a bass component of the audio signal from the media player 104. In other embodiments, the second vibration member may be configured as a component of another audio driver. For example, each earcup 108 may include a first audio driver 132A, which may be particularly suited for treble playback and configured to produce audio playback in response to receipt of at least a treble component of an audio signal from the media player 104, and a second audio driver 132B, which may be particularly suited for bass playback and configured to produce audio playback in response to receipt of at least the bass component of the audio signal from the media player 104.

The media player 104 may store or have access to at least audio media for playback over the noise-canceling headphone 102. The media player 104 may include, for example, a smartphone, tablet, computer, television, e-reader with audio capabilities, digital file player, disc player, radio, stereo, gaming system, etc. The media player 104 may be operatively connected to the noise-canceling headphone 102 by a wireless connection 116, over a wired connection 118, or both. For example, the noise-canceling headphone 102 may connect wirelessly to the media player 104 utilizing a BLUETOOTH® wireless connection protocol and may form a wired connection to the media player 104 utilizing one or more wires 120 having audio jacks 122 at two, opposite ends thereof. One of the audio jacks 122 may be inserted into a corresponding audio plug 124 of the media player 104, and the one or more of the other audio jacks 122 may be inserted into a corresponding audio plug 126 located on, for example, the first earcup 108, the second earcup, 112, or one on each of the first earcup 108 and the second earcup 112.

Figure 2:
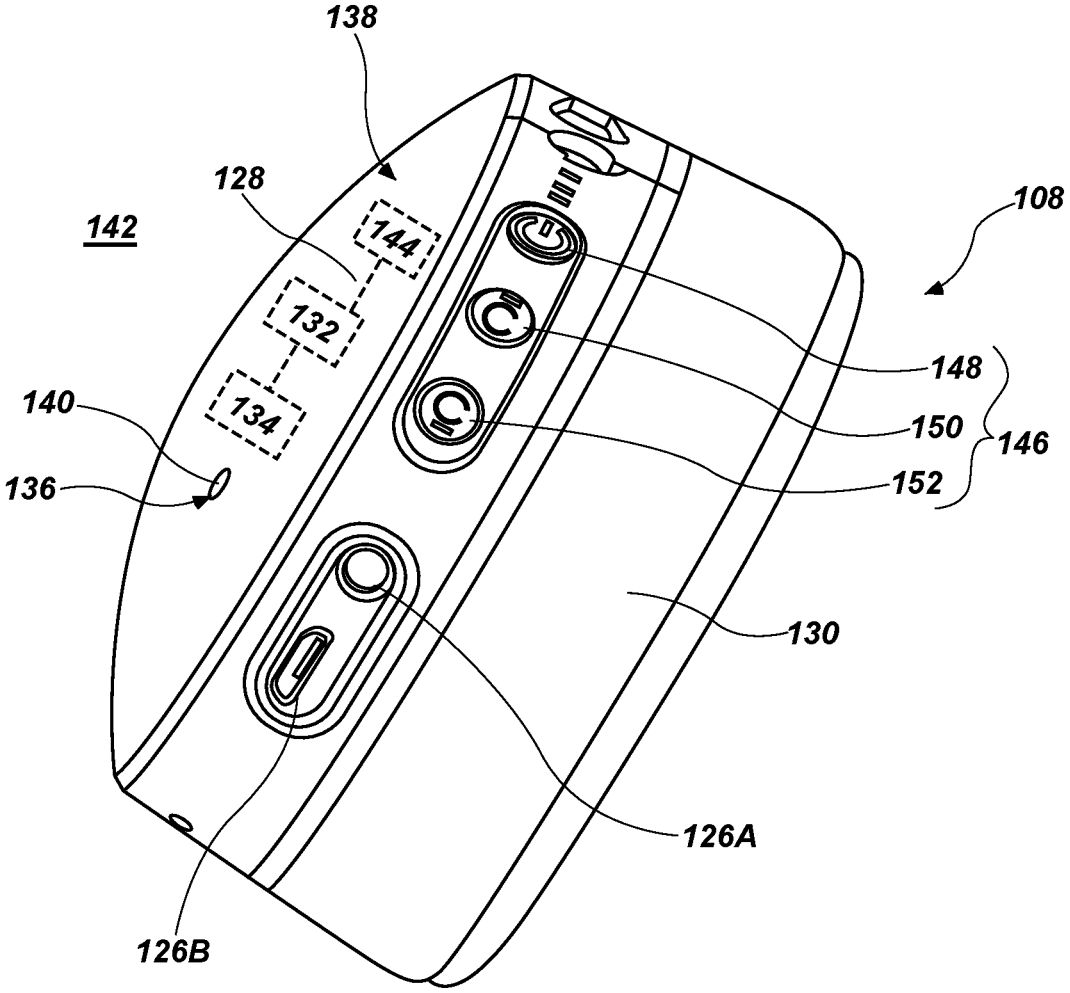
FIG. 2 is a perspective bottom view of a first earcup of the noise-canceling headphone of FIG. 1.

FIG. 2 is a perspective bottom view of the first earcup 108 of the noise-canceling headphone 102 of FIG. 1. The first earcup 108 may include a rigid housing 128 and a cushion 130 located on a side of the housing 128 proximate the ear of the user when the noise-canceling headphone 102 (see FIG. 1) is worn by the user. The housing 128 may include an opening 136 extending at least partially through a back plate 138 of the housing 128, the back plate 138 located on a side of the housing 128 opposite the cushion 130. The opening 136 may expose a first microphone 140 at an exterior 142 of the housing 128. The first microphone 140 may, for example, be used for at least two purposes: voice pickup and noise cancelation. For example, when voice commands or voice calls are being received via the noise-canceling headphone 102 (see FIG. 1), the first microphone 140 may be monitored, and the voice commands and voice audio may be detected via the first microphone 140. As another example, when audio playback is being provided via the noise-canceling headphone 102 (see FIG. 1), the first microphone 140 may be monitored, and the environmental noise detected via the first microphone 140 may be employed to reduce the impact of such environmental noise on the listening experience, as described in greater detail below.

In some embodiments, such as that shown in FIG. 2, the first earcup 108 may include a first audio plug 126A configured to accept an audio jack 122 (see FIG. 1) and a second power plug 126B configured to accept a power jack. For example, the first audio plug 126A may be located proximate a bottom of the housing 128 when the noise-canceling headphone 102 (see FIG. 1) is worn by the user between the cushion 130 and the back plate 138, and may be configured as, for example, a tip-ring-sleeve-type plug. More specifically, the first audio plug 126A may be configured in a tip-ring-sleeve (TRS), tip-ring-ring-sleeve (TRRS), tip-ring-ring-ring-sleeve (TRRRS), etc., and may operably couple with audio jacks 122 (see FIG. 1) having complementary configurations. The second power plug 126B may be located adjacent to the first audio plug 126A at the bottom of the housing 128 when the noise-canceling headphone 102 (see FIG. 1) is worn by the user, and the second power plug 126B may be configured as, for example, a power-and-data-connection-type plug specifically configured to receive power to charge a battery 144 configured to power electrical components of the noise-canceling headphone 102 (see FIG. 1). More specifically, the second power plug 126B may be configured as, for example, a universal serial bus (USB), mini-USB, or LIGHTNING® connector. Although specific examples have been provided, the audio plug 126 or audio and power plugs 126A and 126B may be configured as any type of plug for receiving an audio jack 122 (see FIG. 1) configured to convey audio signals, power, or both. In other embodiments, the second power plug 126B may further be configured to receive an audio signal via a data connection portion of the power-and-data-connection-type plug.

The first earcup 108 may further include buttons 146 configured to affect the powered state or the operation of the noise-canceling headphone 102 (see FIG. 1), the buttons 146 located on the housing 128 between the cushion 130 and the back plate 138. For example, the first earcup 108 may include a power button 148 configured to power and unpower powered electrical components of the noise-canceling headphone 102 (see FIG. 1) in response to successive and/or sustained presses. In addition, the first earcup 108 may include a vibration increase button 150 and a vibration decrease button 152 in embodiments where the noise-canceling headphone 102 (see FIG. 1) includes tactile vibrators 134, which may increase and decrease the intensity of vibrations produced by the tactile vibrators 134 in response to pressing the requisite button 150 or 152, as explained in further detail below.

Figure 3:
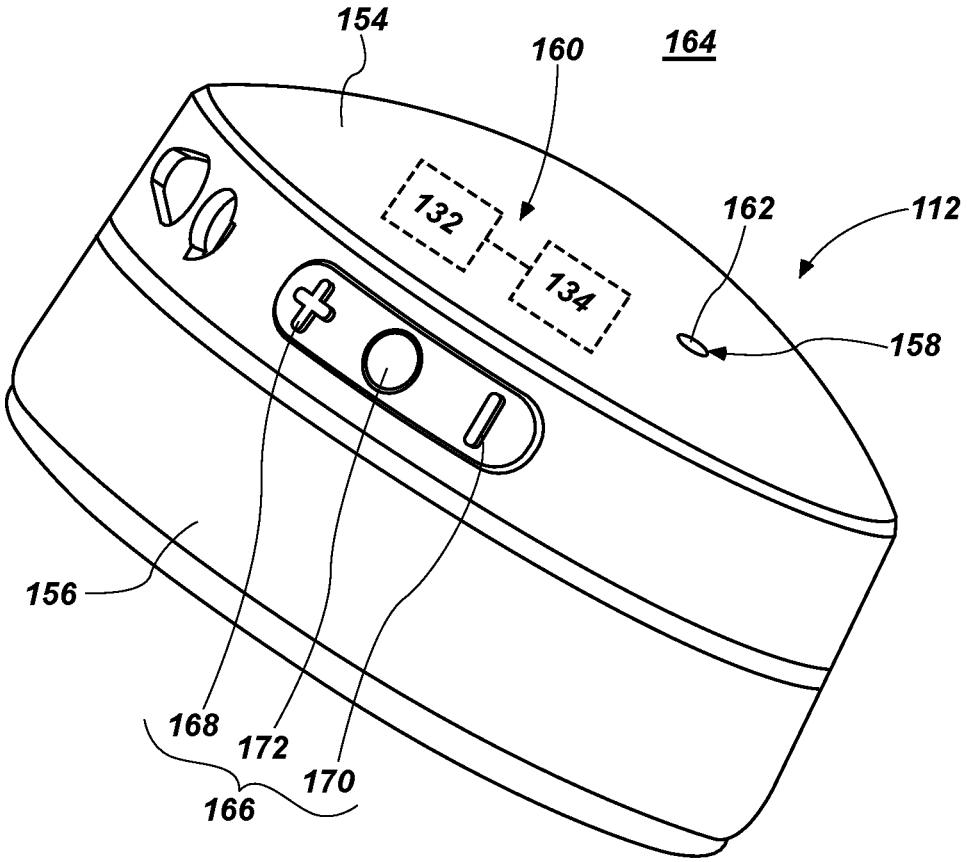
FIG. 3 is a perspective bottom view of a second earcup of the noise-canceling headphone of FIG. 1.

FIG. 3 is a perspective bottom view of the second earcup 112 of the noise-canceling headphone 102 of FIG. 1. Like the first earcup 108 (see FIG. 2), the second earcup 112 may include a rigid housing 154 and a cushion 156 located on a side of the housing 154 proximate the ear of the user when the noise-canceling headphone 102 (see FIG. 1) is worn by the user. The housing 154 may include an opening 158 extending at least partially through a back plate 160 of the housing 154, the back plate 160 located on a side of the housing 154 opposite the cushion 156. The opening 158 may expose another first microphone 162 at an exterior 164 of the housing 154. The other first microphone 162 may also be used for voice pickup and noise cancelation. Providing a first microphone 140 (see FIG. 2) and 162 on each of the earcups 108 (see FIG. 2) and 112 may enable stereo voice pickup and independent left and right noise-canceling. In other embodiments, only one of the earcups 108 (see FIG. 2) and 112 may include the respective first microphone 140 (see FIG. 2) or 162.

The second earcup 112 may include a multifunction button 166 configured to increase and decrease a volume of the audio drivers 132 and otherwise affect operation of the noise-canceling headphone 102 (see FIG. 1), the multifunction button 166 located on the housing 154 between the cushion 156 and the back plate 160. For example, the multifunction button 166 may include a volume increase button 168, a volume decrease button 170, and a central button 172 that may, for example, increase volume of the audio drivers 132, decrease volume of the audio drivers 132, start and stop playback, accept voice calls, initiate voice commands, and otherwise affect operation of the noise-canceling headphone 102 and associated media player 104 (see FIG. 1) depending on press occurrence, number, and/or duration.

Figure 4:
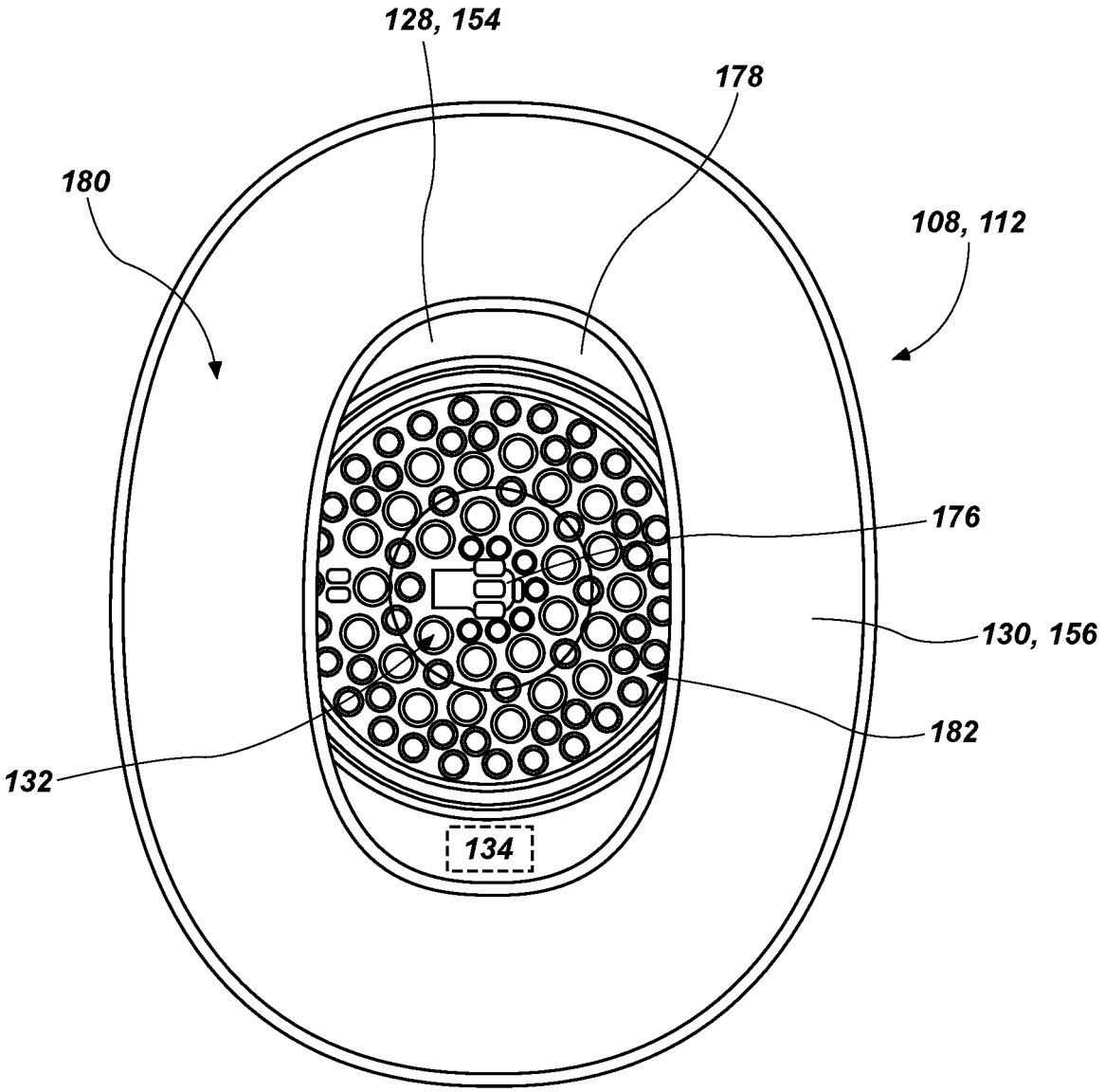
FIG. 4 is a front view of one of the earcups of the noise-canceling headphone of FIG. 1.

FIG. 4 is a front view of one of the earcups 108 or 112 of the noise-canceling headphone 102 of FIG. 1. At least one of the earcups 108 or 112, or optionally both earcups 108 and 112, may include a second microphone 176 located between the second vibration member, depicted in FIG. 4 as the tactile vibrator 134, and an ear of a user when the noise-canceling headphone 102 (see FIG. 1) is worn by the user. More specifically, the second microphone 176 may be located on a side of the audio driver 132 proximate the ear of the user when the noise-canceling headphone 102 (see FIG. 1) is worn by the user. As a specific, nonlimiting example, the second microphone 176 may be located within a recess 178 formed by the cushion 130 and/or 156 between a surface 180 of the cushion 130 and/or 156 positioned to contact the user when the noise-canceling headphone 102 (see FIG. 1) is worn by the user and a cover 182 of the audio driver 132 exposed toward the ear of the user within the recess 178 (e.g., secured to the cover 182). The second microphone 176 may enable the first vibration member 206 (see FIG. 5), depicted in FIG. 4 as the audio driver 132, to at least partially cancel at least the incidental noise produced by the second vibration member, depicted in FIG. 4 as the tactile vibrator 134, as described in greater detail below. The second microphone 176 may include, for example, a micro-electrical-mechanical system (MEMS) microphone or an electret condenser microphone (ECM).

While specific combinations of features for individual earcups 108 and 112 associated with the particular left-side and right-side earcups 108 and 112 have been shown and described in connection with FIGS. 1 through 4, those features may be placed in different combinations with one another on either earcup 108 or 112. For example, the plug or plugs 126 may be located on the left-side or right-side earcup 108 or 112, the audio plug 126A may be located on a different earcup 108 or 112 than the power plug 126B, the buttons 146 and 166 may be located on the same earcup 108 or 112, etc.

Figure 5:
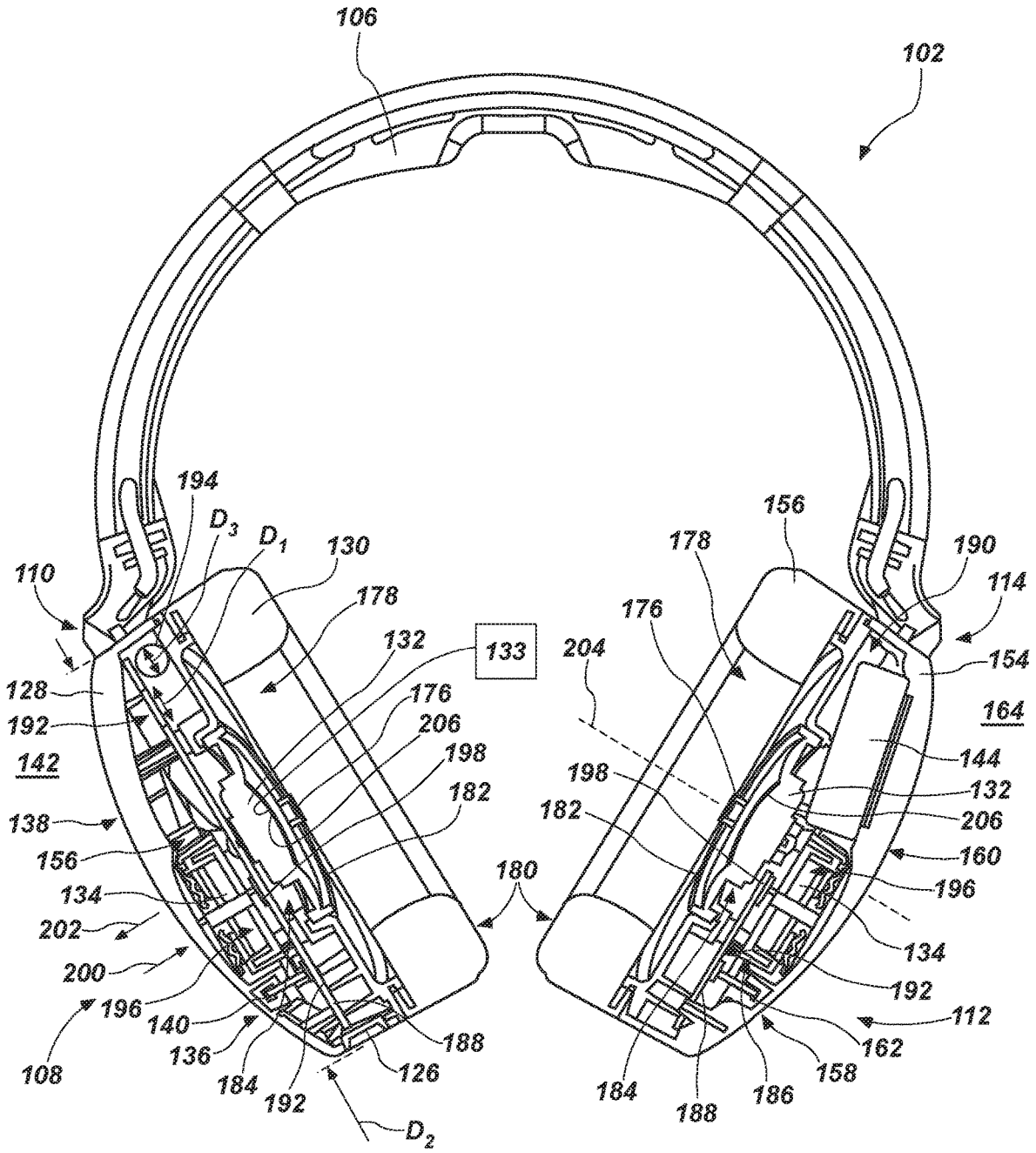
FIG. 5 is a cross-sectional side view of the noise-canceling headphone of FIG. 1.

FIG. 5 is a cross-sectional side view of the noise-canceling headphone 102 of FIG. 1. The housing 128 and 154 of each earcup 108 and 112 may form a first acoustic cavity 184 located proximate the ear of the user when the noise-canceling headphone 102 is worn by the user and a second acoustic cavity 186 located on a side of the first acoustic cavity 184 opposite the ear of the user. The first vibration member 206, depicted in FIG. 5 as being associated with an audio driver 132, may be located at least partially within the first acoustic cavity 184, and the second vibration member 196, depicted in FIG. 5 as being associated with a tactile vibrator 134, may be located at least partially within the second acoustic cavity 186. More specifically, the audio driver 132 may be contained within the first acoustic cavity 184, with the cover 182 of the audio driver 132 and portions of the housing 128 and 154 forming an ear-facing border of the first acoustic cavity 184, and the tactile vibrator 134 may be contained within the second acoustic cavity 186.

At least one of the first vibration member 206 and the second vibration member 196 may produce incidental noise that may result in a detectable sound pressure level (SPL) profile different from an intended SPL profile for the noise-canceling headphone 102, at least at some frequencies. For example, the second vibration member 196 may produce audible noise outside its intended audible response, which may be detectable as an audible buzz in embodiments there the second vibration member 196 is a component of a tactile vibrator 134. More specifically, the second vibration member 196 may produce undesirable audible noise in addition to tactile vibrations within its intended frequency response (e.g., primarily frequencies between about 20 Hz and about 250 Hz, such as, for example, between about 20 Hz and about 100 Hz or between about 30 Hz and about 60 Hz) and may vibrate at frequencies (e.g., frequencies above about 250 Hz) outside its intended frequency response (e.g., primarily frequencies between about 20 Hz and about 250 Hz), which may be caused by, for example, harmonic resonance or imperfect signal filtering. As another example, each of the first vibration member 206 and the second vibration member may produce audible noise outside their intended audible responses, which may be detectable as buzzing bass from a first, high-frequency audio driver 132A (see FIG. 1) and muddy mids and treble from a second, low-frequency audio driver 132B (see FIG. 1). More specifically, each of the first vibration member 206 and the second vibration member may vibrate at frequencies (e.g., frequencies below about 250 Hz and above about 250 Hz, respectively) outside an intended frequency response (e.g., primarily frequencies between about 20 Hz and about 250 Hz and between about 250 Hz and about 6 kHz, respectively) of the first vibration member 206 and the second vibration member, which may also be caused by, for example, harmonic resonance or imperfect signal filtering.

The second microphone 176 may enable modification of the audio signal sent to the audio driver 132, causing the audio driver 132 to produce a detectable SPL profile 133 that, when emitted, combines with the existing SPL profile at the interior of a respective earcup 108 or 112 to better match a heard SPL profile to an intended SPL profile for the noise-canceling headphone 102, reducing the impact of incidental noise and other undesirable audio emissions produced by the tactile vibrator 134 on the listening experience. The second microphone 176 may also enable modification of the audio signal sent to the first audio driver 132A, the second audio driver 132B, or both the first audio driver 132A and the second audio driver 132B, causing first audio driver 132A, the second audio driver 132B, or both the first audio driver 132A and the second audio driver 132B to produce a detectable SPL profile 133 that, when emitted, combines with other pressure phenomena to better match a heard SPL profile to an intended SPL profile for the noise-canceling headphone 102, reducing the impact of incidental noise produced by the other of the first audio driver 132A, the second audio driver 132B, or both the first audio driver 132A and the second audio driver 132B on the listening experience.

A driver plate 188 may subdivide a hollow interior 190 of the housing 128 and 154, and may be located between the first vibration member 206 and the second vibration member 196 (between the audio driver 132 and the tactile vibrator 134 in FIG. 5), to form the first acoustic cavity 184 and the second acoustic cavity 186. The driver plate 188 may include at least one passage 192 extending between the first acoustic cavity 184 and the second acoustic cavity 186. A greatest diameter $D_1$ of any passage 192 may be, for example, between about 5% and about 10% of a greatest diameter $D_2$ of the housing 128 and 154. More specifically, the greatest diameter $D_1$ of any passage 192 may be, for example, between about 6% and about 9% of the greatest diameter $D_2$ of the housing 128 and 154. The housing 128 and 154 may further include at least one port 194 extending from the first acoustic cavity 184, through the housing 128 and 154, to the exterior 142 and 164. A greatest diameter $D_3$ of any port 194 may be, for example, between about 5% and about 10% of the greatest diameter $D_2$ of the housing 128 and 154. More specifically, the greatest diameter $D_3$ of any port 194 may be, for example, between about 7% and about 8% of the greatest diameter $D_2$ of the housing 128 and 154.

In embodiments where the second vibration members 196 are components of tactile vibrators 134, the tactile vibrators 134 of the noise-canceling headphone 102 may be capable of producing high-amplitude, tactile vibrations to augment at least a bass listening experience of the user, which may tend to cause a second vibrating member 196 (e.g., a mass of vibrating material) of the tactile vibrators 134 to move beyond intended boundaries therefor. To better constrain movement of the second vibration member 196, each earcup 108 and 112 may include a compressible material 198 secured to the driver plate 188 on a side of the driver plate opposite the audio driver 132 and on a side of the tactile vibrator 134 proximate the ear of the user when the noise-canceling headphone 102 is worn by the user. The compressible material 198 may be positioned and configured to delimit movement of the second vibration member 196 of the tactile vibrator 134 in a first direction 200. The compressible material 198 may include, for example, a felt or foam material (e.g., neoprene or acoustic foam). The back plate 138 and 160 of each housing 128 and 154 located on a side of the tactile vibrator 134 opposite the audio driver 132 and distal from the ear of the user when the noise-canceling headphone 102 is worn by the user may delimit movement of the second vibration member 196 the tactile vibrator 134 in a second, opposite direction 202.

As shown in FIG. 5, the second microphones 176 of the earcups 108 and 112 may be, for example, centrally located within the recess 178 and on each respective earcup 108 and 112. More specifically, a line 204 passing through a geometric center of the first vibration member 206 of the audio driver 132 in a direction at least substantially parallel to a direction of intended movement of the first vibration member 206 of the audio driver 132 may intersect with the second microphone 176.

Figure 6:
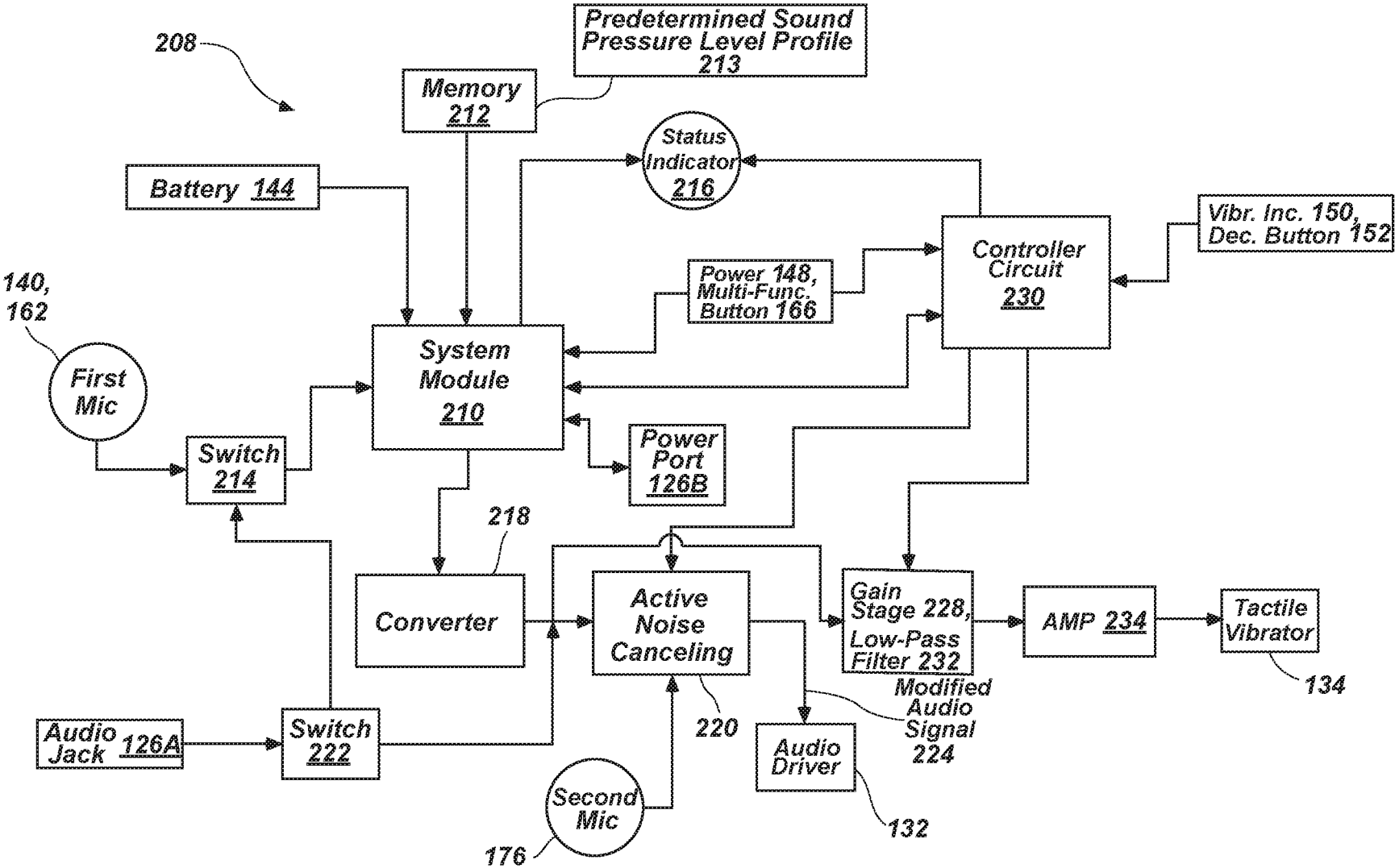
FIG. 6 is a schematic of circuitry for controlling the noise-canceling headphone of FIG. 1.

FIG. 6 is a schematic of circuitry 208 for controlling the noise-canceling headphone 102 of FIG. 1. The circuitry 208 may be at least substantially duplicated in each earcup 108 and 112 (see FIG. 1), enabling independent operation and powering of each earcup 108 and 112 (see FIG. 1), or may be at least partially divided among the earcups 108 and 112 (see FIG. 1) such that at least some of the circuitry 208 in a single earcup 108 or 112 (see FIG. 1) controls the operation and/or powering of both. The circuitry 208 may receive an incoming audio signal from a connected media player 104 (see FIG. 1) at a system module 210 including wireless communication functionality or at the audio jack 126A. The system module 210 may be configured as a system-on-a-chip, and may, for example, be configured to form and communicate over wireless connections, manage power consumption and charging, accept and process control inputs, and process and route audio signals. Suitable system modules 210 are commercially available from, for example, Qualcomm, Inc. of 5775 Morehouse Drive, San Diego, Calif. 92121. The system module 210 may be operatively connected to memory 212 storing instructions for configuring the operation of the system module (e.g., firmware). The battery 144 and power plug 126B may be operatively connected to the system module 210 to enable charging of the battery 144 via the power plug 126B. A status indicator 216 (e.g., an RGB LED) may be operatively connected to the system module 210, and may selectively indicate a status of the noise-canceling headphone 102 (see FIG. 1) in response to control signals from the system module 210. Signals from the first microphone 140 and 162 may be sent to the system module 210 directly or through a switch 214 that may toggle when signals from the first microphone 140 and 162 are being monitored.

The signals received directly at the system module 210 or sent to the system module 210 from the audio jack 126A and/or the first microphone 140 and 162 may be routed through a converter 218, which may be configured to convert any signals in the form of differential signals to analog signals. The audio input received from the system module 210 or the audio jack 126A and the environmental noise received from the first microphone 140 and 162 may then be sent to an active-noise-canceling module 220. When the audio input is received from the audio jack 126A and is already in analog format, a switch 222 operatively connected between the audio jack 126A, the system module 210, and the active-noise-canceling module 220 may route the audio input directly to the active-noise-canceling module 220. Although an embodiment involving analog signal routing and noise-cancelation is particularly described herein, the audio input received may remain in digital format, may be converted to digital format, and may be in either analog or digital format during signal routing, noise-cancelation, or both. The second microphone 176 may send a signal representative of detected audio directly to the active-noise-canceling module 220.

The active-noise-canceling module 220 may include at least a feed-forward, noise-cancelation circuit operatively connected between the first microphone 140 and 162 and at least the first vibration member 206, which is associated with the audio driver 132 in FIG. 6, and a feedback, noise-cancelation circuit operatively connected between the second microphone 176 and at least the first vibration member 206 of the audio driver 132. Suitable active-noise-canceling modules 220 are commercially available from, for example, ams AG of Tobelbader Strasse 30, Premstaetten, 8141 AT, among other suppliers de AnalogDevices, Sony, Cirrus Logic, Qualcomm, etc.). The feed-forward, noise-cancelation circuit may be configured to compare a signal from the first microphone 140 and 162 to a predetermined, desired SPL profile 213 and generate at least a portion of a modified audio signal 224 configured to cancel environmental noise by, for example, amplifying pressure at one or more frequencies, reducing pressure at one or more frequencies, or amplifying pressure at one or more frequencies and reducing pressure at one or more other frequencies. For example, the active-noise-canceling module 220 may produce a portion of the modified audio signal 224 by combining the audio input with a noise-canceling signal of the same amplitude as the detected environmental noise and having inverted phase relative to the detected noise. The modified audio signal 224 may be sent to the audio driver 132, and when the modified audio signal 224 is played over the audio driver 132, the resulting audio may be perceived by the user as primarily the audio content sent from the media player 104 (see FIG. 1) without the environmental noise, the environmental noise being at least partially canceled by destructive interference.

The feedback, noise-cancelation circuit may be configured to compare a signal from the second microphone 176 to the predetermined, desired SPL profile 213 and generate at least another portion of the modified audio signal 224 configured to cancel incidental noise from the tactile vibrator 134 by, for example, amplifying pressure at one or more frequencies, reducing pressure at one or more frequencies, or amplifying pressure at one or more frequencies and reducing pressure at one or more other frequencies. For example, the active-noise-canceling module 220 may produce another portion of the modified audio signal 224 by combining the audio input with another noise-canceling signal of the same amplitude as the detected incidental noise from the tactile vibrator 134 and having inverted phase relative to the detected incidental noise from the tactile vibrator 134. More specifically, the active-noise-canceling module 220 may be configured to at least partially reduce (e.g., at least partially cancel or eliminate) undesirable audible noise produced by the tactile vibrator 134 at least at frequencies between about 20 Hz and about 250 Hz (e.g., between about 20 Hz and about 100 Hz or between about 30 Hz and about 60 Hz). The modified audio signal 224 may be sent to the audio driver 132, and when the modified audio signal 224 is played over the audio driver 132, and its sound is naturally combined with the incidental noise from the tactile vibrator 134, the resulting audio may be perceived by the user as primarily the audio content sent from the media player 104 (see FIG. 1) without the incidental noise from the tactile vibrator 134, the incidental noise from the tactile vibrator 134 being at least partially canceled by destructive interference.

In other embodiments, the feedback, noise-cancelation circuit may be configured to compare the signal from the second microphone 176 to the predetermined, desired SPL profile 213 and generate at least another portion of separate modified audio signals to be sent to the first audio driver 132A and the second audio driver 132B, respectively, the modified audio signals configured to cancel the undesirable audible response (e.g., buzzing bass or muddy mids and treble) of at least one of the first audio driver 132A, the second audio driver 132B, or both the first audio driver 132A and the second audio driver 132B (see FIG. 1) by, for example, amplifying pressure at one or more frequencies, reducing pressure at one or more frequencies, or amplifying pressure at one or more frequencies and reducing pressure at one or more other frequencies. For example, the active-noise-canceling module 220 may produce one other portion of the modified audio signal 224 by combining the audio input with another noise-canceling signal of the same amplitude as the detected audible response from the second audio driver 132B that is outside the predetermined, desired SPL profile 213 and having inverted phase relative to the detected incidental noise from the second audio driver 132B. The one portion of the modified audio signal may be sent to the first audio driver 132A, and when the one portion of the modified audio signal is played over the first audio driver 132A, the resulting audio may be perceived by the user as primarily the audio content sent from the media player 104 (see FIG. 1) without the detected audible response from the second audio driver 132B that is outside the predetermined, desired SPL profile 213, the detected audible response from the second audio driver 132B that is outside the predetermined, desired SPL profile 213 being at least partially canceled by destructive interference. Continuing the example, the active-noise-canceling module 220 may produce another portion of the modified audio signal by combining the audio input with another noise-canceling signal of the same amplitude as the detected audible response from the first audio driver 132A that is outside the predetermined, desired SPL profile 213 and having inverted phase relative to the detected incidental noise from the first audio driver 132A. The other portion of the modified audio signal may be sent to the second audio driver 132B, and when the other portion of the modified audio signal is played over the second audio driver 132B, the resulting audio may be perceived by the user as primarily the audio content sent from the media player 104 (see FIG. 1) without the detected audible response from the first audio driver 132A that is outside the predetermined, desired SPL profile 213, the detected audible response from the first audio driver 132A that is outside the predetermined, desired SPL profile 213 being at least partially canceled by destructive interference.

The circuitry 208 may include further processing for the audio signal before it is passed on to the tactile vibrator 134. For example, the circuitry 208 may include a gain stage 228 located between the converter 218 and the tactile vibrator 134. The gain stage 228 may be configured to increase a voltage of the audio signal before the audio signal reaches the tactile vibrator 134. Such an increase in voltage may determine an amplitude, and corresponding intensity, of the tactile vibrations produced by the tactile vibrator 134. The degree of increase may be incremented in steps in response to successive presses of the vibration increase and decrease buttons 150 and 152, signals from which may be received at a controller circuit 230. The controller circuit 230 may be operatively connected to the status indicator 216 to provide feedback about the degree of increase in intensity of the tactile vibrations. The controller circuit 230 may include a series of switches with resistors of varying electrical resistance to determine the degree of increase in voltage applied by the gain stage 228. In other embodiments, a variable resistor with accompanying slider may be used in place of the controller circuit 230 and vibration increase and decrease buttons 150 and 152 to provide a smooth, rather than stepped, increase or decrease in voltage applied by the gain stage 228. The gain stage 228 may include, for example, an operational amplifier.

The circuitry 208 may include a low-pass filter 232 immediately following the gain stage 228. The low-pass filter 232 may be configured to remove a treble component of the voltage-amplified, audio signal from passage to the tactile vibrator 134 and pass a bass component of the audio signal to the tactile vibrator 134. More specifically, the low-pass filter 232 may, for example, be configured to remove frequencies of about 250 Hz or greater from the audio signal from passage to the tactile vibrator 134 and pass those portions of the audio signal at frequencies of about 250 Hz or less to the tactile vibrator 134. As specific, nonlimiting examples, the low-pass filter 232 may be configured to remove frequencies of about 100 Hz or greater or 60 Hz or greater from the audio signal from passage to the tactile vibrator 134 and pass those portions of the audio signal at frequencies of about 100 Hz or less or 60 Hz or less to the tactile vibrator 134. By placing the low-pass filter 232 in the circuitry after the gain stage 228, the low-pass filter 232 may reduce (e.g., eliminate) unwanted noise inherently introduced into the audio signal by the gain stage 228 because such noise may primarily be found at frequencies above bass frequencies.

The circuitry 208 may also include an amplifier 234 operatively connected between the low-pass filter 232 and the tactile vibrator 134. The amplifier 234 may be configured to increase an amperage of the audio signal, which may result in the desired power for the tactile vibrations when combined with the increase in voltage from the gain stage 228.

Figure 7:
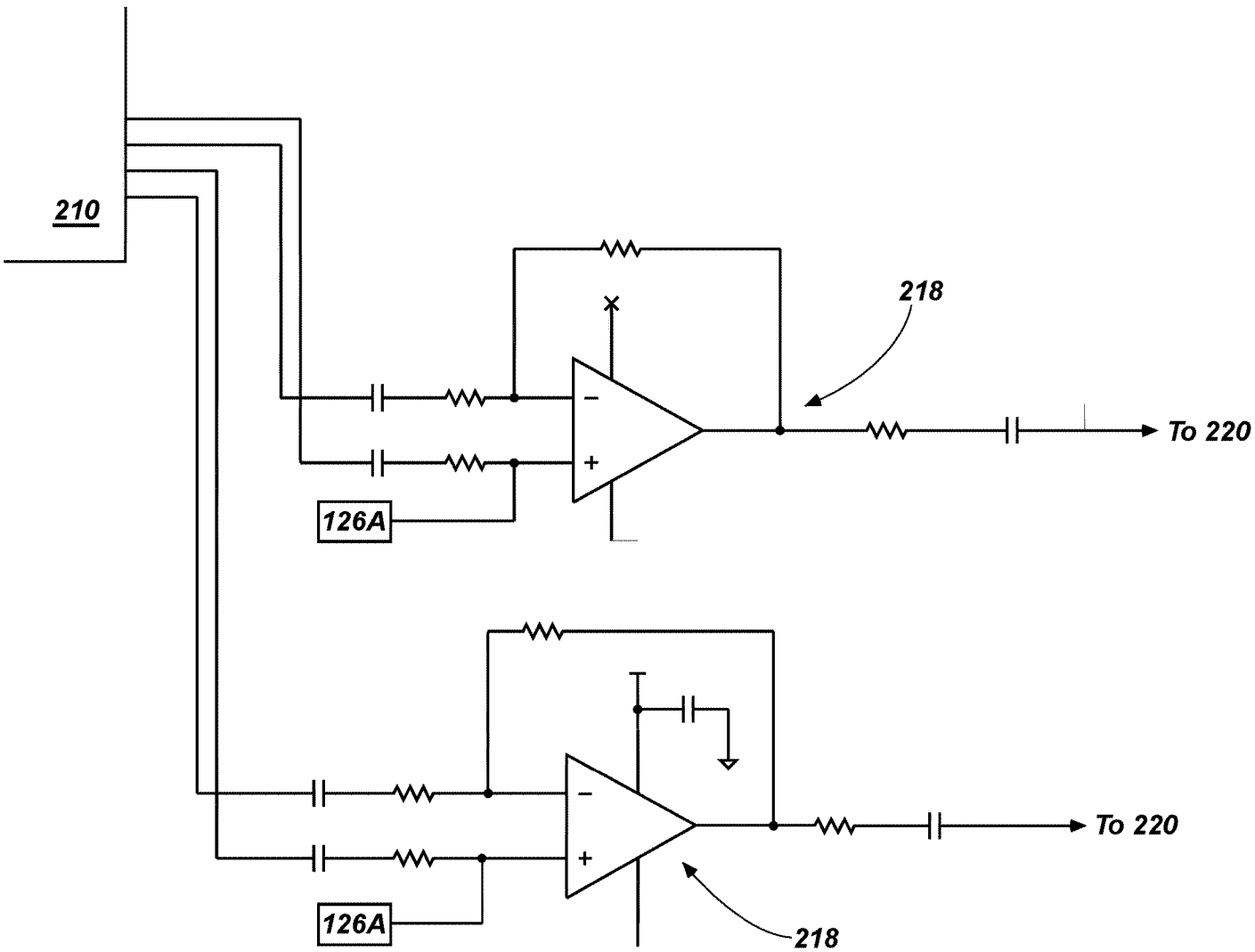
FIGS. 7 through 9 are more detailed schematics of components of the circuitry of FIG. 6.
Figure 8:
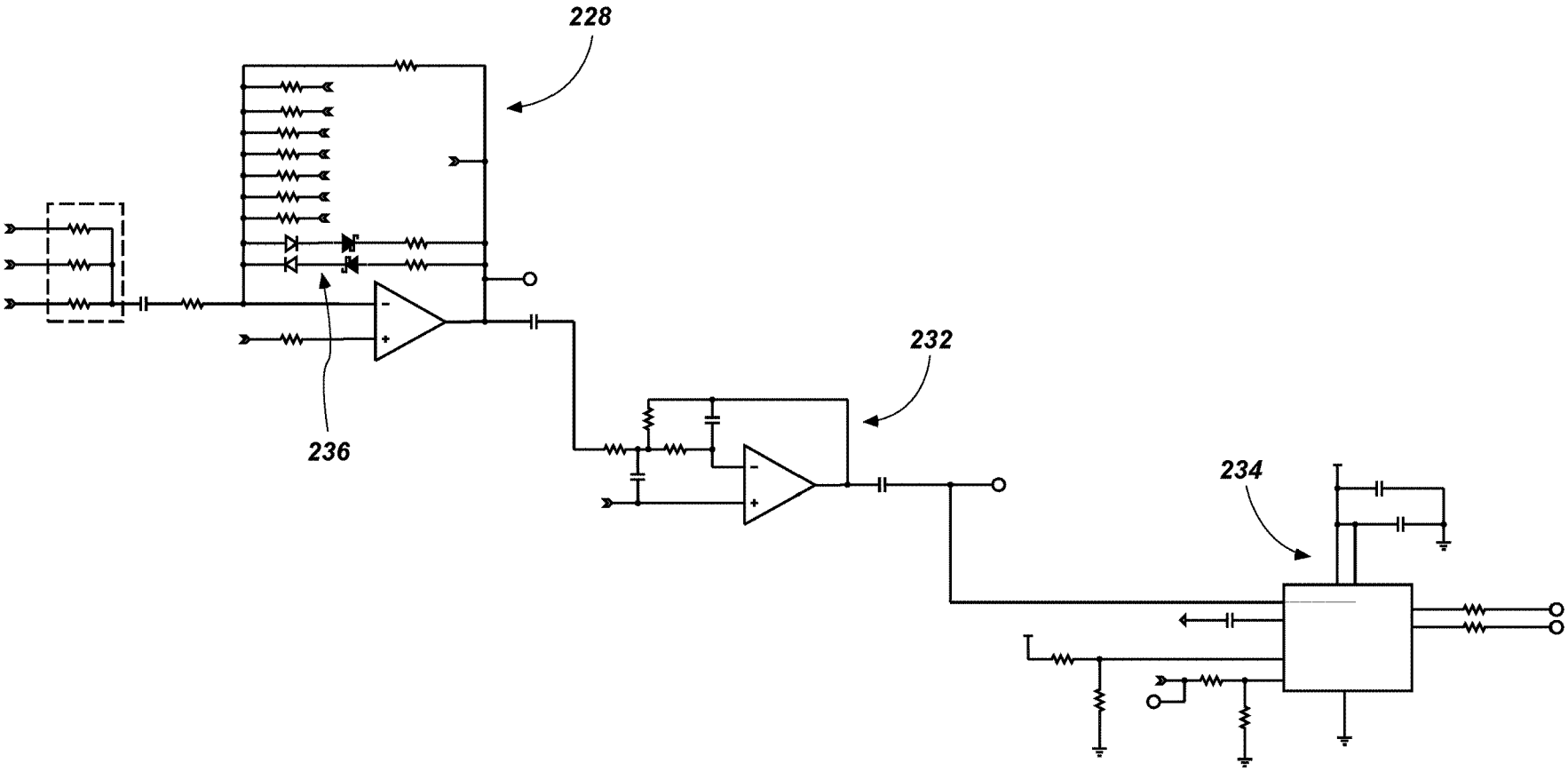
Figure 9:
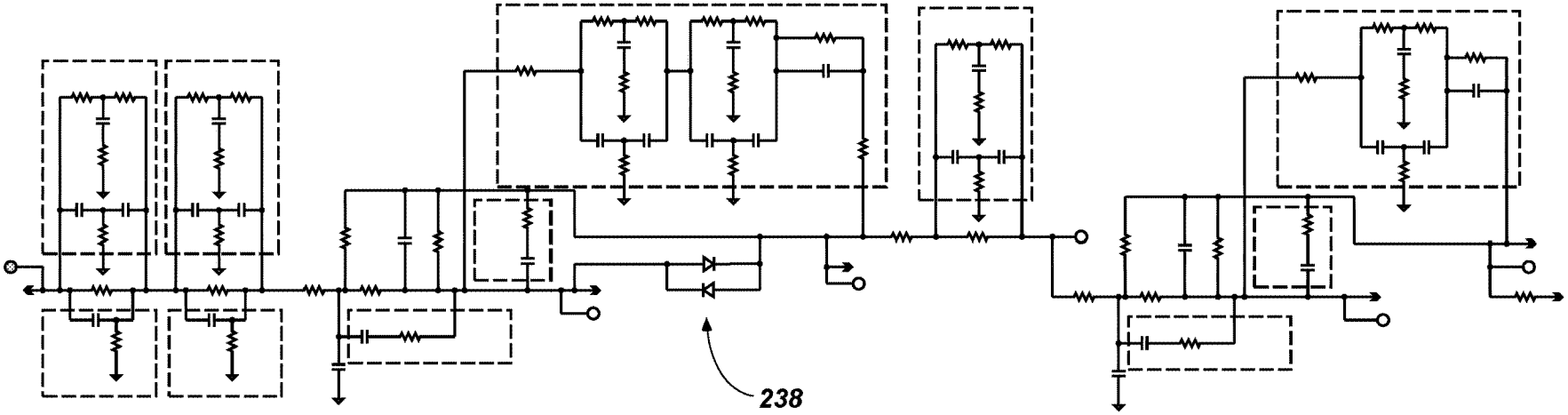

FIGS. 7 through 9 are more detailed schematics of components of the circuitry 208 of FIG. 6. For example, FIG. 7 depicts in greater detail a configuration of electrical components operatively connected to the system module 210 that may collectively form converters 218 for the left and right channels of an audio signal. FIG. 8 depicts in greater detail a configuration of electrical components that may collectively form the gain stage 228, low-pass filter 232, and amplifier 234. As shown in FIG. 8, the gain stage 228 may include a diode limiter 236 configured to at least reduce clipping resulting from gain produced by the gain stage 228. FIG. 9 depicts in still greater detail a configuration of electrical components that may collectively form the low-pass filter 232. As shown in FIG. 9, the low-pass filter 232 may include a diode limiter 238 configured to reduce instability of the low-pass filter 232.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A noise-canceling headphone, comprising:

a headband;

an audio input; and earcups supported proximate ends of the headband, at least one of the earcups operatively connected to the audio input and comprising:

a housing;

a first vibration member operatively connected to the audio input and supported at least partially within the housing;

a second vibration member operatively connected to the audio input and supported at least partially within the housing;

a microphone supported by the housing; and a feedback, noise-cancelation circuit configured to reduce a user's perception of an undesirable audible response of the second vibration member, the feedback, noise-cancelation circuit operatively connected to the microphone, the feedback, noise-cancelation circuit configured to compare a signal from the microphone to a predetermined sound pressure level profile for the noise-canceling headphone in a range of frequencies between about 20 Hz and about 60 Hz, the feedback, noise-cancelation circuit configured to generate a noise-canceling signal of a same amplitude as a portion of the signal from the microphone corresponding to the undesirable audible response of the second vibration member, the noise-canceling signal having inverted phase relative to the portion of the signal from the microphone, the feedback, noise-cancelation circuit configured to modify an audio signal from the audio input at least in part by combining the audio signal with the noise-canceling signal, a modified audio signal generated by the feedback, noise-cancelation circuit configured to at least partially cancel at least a portion of an audible response of the second vibration member, the feedback, noise cancelation circuit configured to output the modified audio signal to the first vibration member responsive to comparing the signal from the microphone to the predetermined sound pressure level profile.

2. The noise-canceling headphone of claim 1, wherein the first vibration member comprises an audio driver and the second vibration member comprises a tactile vibrator.

3. The noise-canceling headphone of claim 2, wherein the feedback, noise-cancelation circuit is configured to at least partially reduce undesirable audible noise produced by the tactile vibrator at least at frequencies between about 20 Hz and about 100 Hz.

4. The noise-canceling headphone of claim 2, further comprising a low-pass filter operatively connected between the audio input and the tactile vibrator, the low-pass filter configured to remove a treble component of the audio signal from passage to the tactile vibrator and pass a bass component of the audio signal to the tactile vibrator.

5. The noise-canceling headphone of claim 4, further comprising a gain stage operatively connected between the audio input and the low-pass filter, the gain stage configured to increase a voltage of the signal from the audio input before the signal from the audio input reaches the tactile vibrator.

6. The noise-canceling headphone of claim 5, wherein the gain stage comprises an operational amplifier.

7. The noise-canceling headphone of claim 5, wherein the gain stage comprises a diode limiter configured to at least reduce clipping resulting from gain produced by the gain stage.

8. The noise-canceling headphone of claim 4, wherein the low-pass filter comprises a diode limiter configured to reduce instability of the low-pass filter.

9. The noise-canceling headphone of claim 1, wherein the first vibration member comprises a first audio driver and the second vibration member comprises a second audio driver.

10. The noise-canceling headphone of claim 1, wherein the microphone is located between the second vibration member and an ear of the user when the noise-canceling headphone is worn by the user.

11. The noise-canceling headphone of claim 10, wherein a line passing through a geometric center of the first vibration member in a direction at least substantially parallel to a direction of intended movement of the first vibration member intersects with the microphone and the microphone is positioned on a side of the first vibration member proximate the ear of the user when the noise-canceling headphone is worn by the user.

12. The noise-canceling headphone of claim 11, wherein the microphone comprises a microelectro-mechanical system (MEMS) microphone.

13. The noise-canceling headphone of claim 1, further comprising:

another microphone exposed at an exterior of the housing; and a feed-forward, noise-cancelation circuit operatively connected to at least the first vibration member and the other microphone, the feed-forward, noise-cancelation circuit configured to reduce a user's perception of environmental noise, the feed-forward, noise-cancellation circuit configured to modify the audio signal from the audio input at least in part based on a signal from the other microphone and send the modified audio signal to the first vibration member, the modified audio signal configured to at least partially cancel at least a portion of the environmental noise.

14. The noise-canceling headphone of claim 1, wherein the at least one of the earcups comprises:

a first acoustic cavity located proximate the ear of the user when the noise-canceling headphone is worn by the user, the first vibration member located in the first acoustic cavity;

a second acoustic cavity located adjacent to the first acoustic cavity and distal from the ear of the user when the noise-canceling headphone is worn by the user, the second vibration member located in the second acoustic cavity; and a driver plate located between the first acoustic cavity and the second acoustic cavity, the driver plate including at least one passage extending between the first acoustic cavity and the second acoustic cavity, a greatest diameter of the at least one passage being between about 5% and about 10% of a greatest diameter of the housing.

15. The noise-canceling headphone of claim 14, further comprising at least one port extending from the first acoustic cavity, through the housing of the earcup, to an exterior of the housing, a greatest diameter of the at least one port being between about 5% and about 10% of the greatest diameter of the housing.

16. The noise-canceling headphone of claim 14, wherein the second vibration member comprises a tactile vibrator and further comprising a compressible material secured to the driver plate and configured to delimit movement of the second vibration member of the tactile vibrator in a first direction, the compressible material located on a side of the tactile vibrator proximate the ear of the user when the noise-canceling headphone is worn by the user.

17. The noise-canceling headphone of claim 16, wherein a portion of the housing located on a side of the tactile vibrator distal from the ear of the user when the noise-canceling headphone is worn by the user is positioned to delimit movement of the second vibration member of the tactile vibrator in a second, opposite direction.

18. A method of making a noise-canceling headphone, comprising:

placing a first vibration member operatively connected to an audio input at least partially within a housing of an earcup;

placing a second vibration member operatively connected to the audio input at least partially within the housing;

supporting a microphone from the housing;

supporting a feedback, noise-cancelation circuit configured to reduce a user's perception of audible noise generated by the second vibration member, the feedback, noise-cancelation circuit operatively connected to the microphone within the housing, the feedback, noise-cancelation circuit configured to compare a signal from the microphone to a predetermined sound pressure level profile for the noise-canceling headphone in a range of frequencies between about 20 Hz and about 60 Hz, the feedback, noise, cancelation circuit configured to generate a noise-canceling signal of a same amplitude as a portion of the signal from the microphone corresponding to an undesirable audible response of the second vibration member, the noise-canceling signal having inverted phase relative to the portion of the signal from the microphone, the feedback, noise-cancelation circuit configured to modify an audio signal from the audio input at least in part by combining the audio signal with the noise-canceling signal, a modified audio signal generated by the feedback, noise-cancelation circuit configured to at least partially cancel at least a portion of an audible response of the second vibration member, the feedback, noise-cancelation circuit configured to output the modified audio signal to the first vibration member responsive to comparing the signal from the microphone to the predetermined sound pressure level profile; and supporting the earcup proximate an end of a headband.

19. The method of claim 18, wherein the second vibration member comprises a tactile vibrator and further comprising supporting a low-pass filter operatively connected between the audio input and the tactile vibrator within the housing, the low-pass filter configured to remove a treble component of the audio signal from passage to the tactile vibrator and pass a bass component of the noise-canceled signal to the tactile vibrator.

20. The method of claim 18, further comprising:

supporting another microphone on the housing, the other microphone exposed at an exterior of the housing; and supporting a feed-forward, noise-cancelation circuit operatively connected to at least an audio driver and the other microphone within the housing, the feed-forward, noise-cancellation circuit configured to reduce a user's perception of environmental noise, the feed-forward, noise-cancellation circuit configured to modify the audio signal from the audio input at least in part based on a signal from the other microphone and send the modified audio signal to the first vibration member, the modified audio signal configured to at least partially cancel at least a portion of the environmental noise.

* * * * *